US006119769A

United States Patent [19]

Yu et al.

[11] Patent Number: 6,119,769

[45] Date of Patent: Sep. 19, 2000

[54] HEAT TRANSFER DEVICE

[75] Inventors: Wen Fei Yu, Ann Arbor; Shyr-Ing Hu, Bloomfield Hills, both of Mich.

[73] Assignee: Visteon Global Technologies, Inc., Dearborn, Mich.

[21] Appl. No.: 09/129,500

[22] Filed: Aug. 5, 1998

[51] Int. Cl.[7] ..... F28F 13/12

[52] U.S. Cl. ..... 165/109.1; 165/184; 138/38; 366/339

[58] Field of Search ..... 165/109.1, 177, 165/184; 138/38; 366/339, 323

[56] References Cited

U.S. PATENT DOCUMENTS

| | | | |
|---|---|---|---|
| 1,139,610 | 5/1915 | Wegner | 366/339 X |
| 2,599,325 | 6/1952 | Fritsberg | 138/38 X |
| 2,861,596 | 11/1958 | Ipsen . | |
| 3,143,768 | 8/1964 | Scherping . | |
| 3,800,985 | 4/1974 | Grout et al. . | |
| 4,090,559 | 5/1978 | Megerlin . | |
| 4,202,635 | 5/1980 | Hendrickson | 366/339 X |
| 4,258,782 | 3/1981 | Kao . | |
| 4,798,241 | 1/1989 | Jarrett et al. | 165/109.1 |
| 5,174,651 | 12/1992 | Gaddis | 366/339 X |
| 5,174,653 | 12/1992 | Halat et al. . | |
| 5,381,600 | 1/1995 | Patel . | |

FOREIGN PATENT DOCUMENTS

| | | | |
|---|---|---|---|
| 605145 | 7/1932 | Germany | 165/177 |
| 1383083 | 3/1988 | Russian Federation . | |
| 966483 | 10/1982 | U.S.S.R. | 165/109.1 |
| 1502953 | 8/1989 | U.S.S.R. | 165/184 |
| 1613835 | 12/1990 | U.S.S.R. | 165/109.1 |
| 1703943 | 1/1992 | U.S.S.R. | 165/109.1 |
| 1783269 | 12/1992 | U.S.S.R. | 165/109.1 |
| 3664 | 12/1894 | United Kingdom . | |
| 417668 | 10/1934 | United Kingdom . | |
| 430015 | 6/1935 | United Kingdom . | |
| 588857 | 6/1947 | United Kingdom . | |
| 2044430 | 10/1980 | United Kingdom | 165/109.1 |

*Primary Examiner*—Leonard Leo
*Attorney, Agent, or Firm*—Raymond L. Coppiellie

[57] ABSTRACT

A heat exchanging device is disclosed. The device includes a fluid flow tube having a turbulator which includes a plurality of coil sections. Each of the coil sections includes a number of coil members of uniform diameter. The coil sections are spaced apart by a predetermined number of other coil members having smaller diameters and different heights than the coil members in the coil sections. These coil configurations force fluid flowing around them into heat exchanging contact with the tube walls.

7 Claims, 4 Drawing Sheets

HEAT TRANSFER DEVICE

BACKGROUND OF THE INVENTION

1. Field of the Invention

The present invention relates to heat transfer devices. More particularly, the present inventions relates to tube for a heat exchange, the tube having a turbulator disposed in it which includes an elongated coil length of non-uniform diameter.

2. Disclosure Information

Fin and tube type heat exchangers are commonly used in vehicle, industrial and residential environments for heating and cooling purposes. Typically, these heat exchangers utilize a plurality of hairpin-shaped tubes to form a heat exchanger, such as an air-to-oil cooler or condenser or the like wherein the fluid passes through the plurality of tubes. The number of tubes depends upon the thermal capacity requirements of the fin and tube heat exchanger. Interleaved between the plurality of tubes are a plurality of stacked fin members which aid in dissipating the heat from the condenser as is well known in the art. A manifold interconnects the tubes so that fluid can flow therethrough.

As is well known in the art of heat exchangers, the greatest heat exchange is achieved by providing a turbulent flow around a maximum possible area of material across which the desired heat exchange may take place. Various devices have been proposed to increase material areas, such as, for example, fins, baffles, or corrugations across which passes a cooling medium. Such a device is taught in U.S. Pat. No. 5,381,600, assigned to the assignee of the present invention. The '600 patent teaches the use of corrugated tube walls to increase surface area to increase heat transfer. Other devices have also been proposed to induce turbulence within a heat exchanger. Kao, in U.S. Pat. No. 4,258,782, teaches inserting a cylinder with edgewise fins into a heat exchanger. Megerlin, in U.S. Pat. No. 4,090,559, teaches the use of a spiral brush to turbulate fluid flow. However, all of the prior art approaches have shortcomings relating to either the manufacturing or performance thereof. It would be advantageous to provide a turbulator which is easily inserted into a tube and which is inexpensive to manufacture.

SUMMARY OF THE INVENTION

The present invention overcomes the disadvantages of the prior art by providing a heat transfer device comprising a thermally conductive tube having an interior surface and a predetermined interior diameter for receiving a flow of fluid through it. The device also includes a fluid flow turbulator disposed in the tube having a longitudinal axis parallel to the longitudinal axis of the tube. At least a portion of the turbulator contacts the interior surface of the tube. The turbulator comprises an elongated length of a coil spring having a non-uniform diameter along its length. The length includes a plurality of coil sections each having a plurality of coil members of uniform height and uniform diameter approximately equal to the interior diameter of the tube and which contact the tube interior. The coil sections are spaced between a predetermined number of transitional coil members each having a diameter smaller than the interior diameter of the tube so as to form an obstructed fluid flow path through the interior of the tube. The transitional coil members direct the fluid to the interior surfaces of the tube as the fluid flows through it.

In one embodiment, the transitional coils are offset from the longitudinal axis of the tube and have a height smaller than the height of the coil members in the coil sections. The turbulator can be fabricated as a single piece or from a plurality of separate spring sections.

It is an advantage of the present invention that an easily inserted, inexpensive turbulator can be utilized to increase the heat transfer efficiency of a heat exchanger tube. Furthermore, since round tubes can be used with the present turbulator, the strength of the tubes is increased. These and other objects, features and advantages of the present invention will become apparent from the drawings, detailed description and claims which follow.

DETAILED DESCRIPTION OF THE PREFERRED EMBODIMENTS

Figure 1:
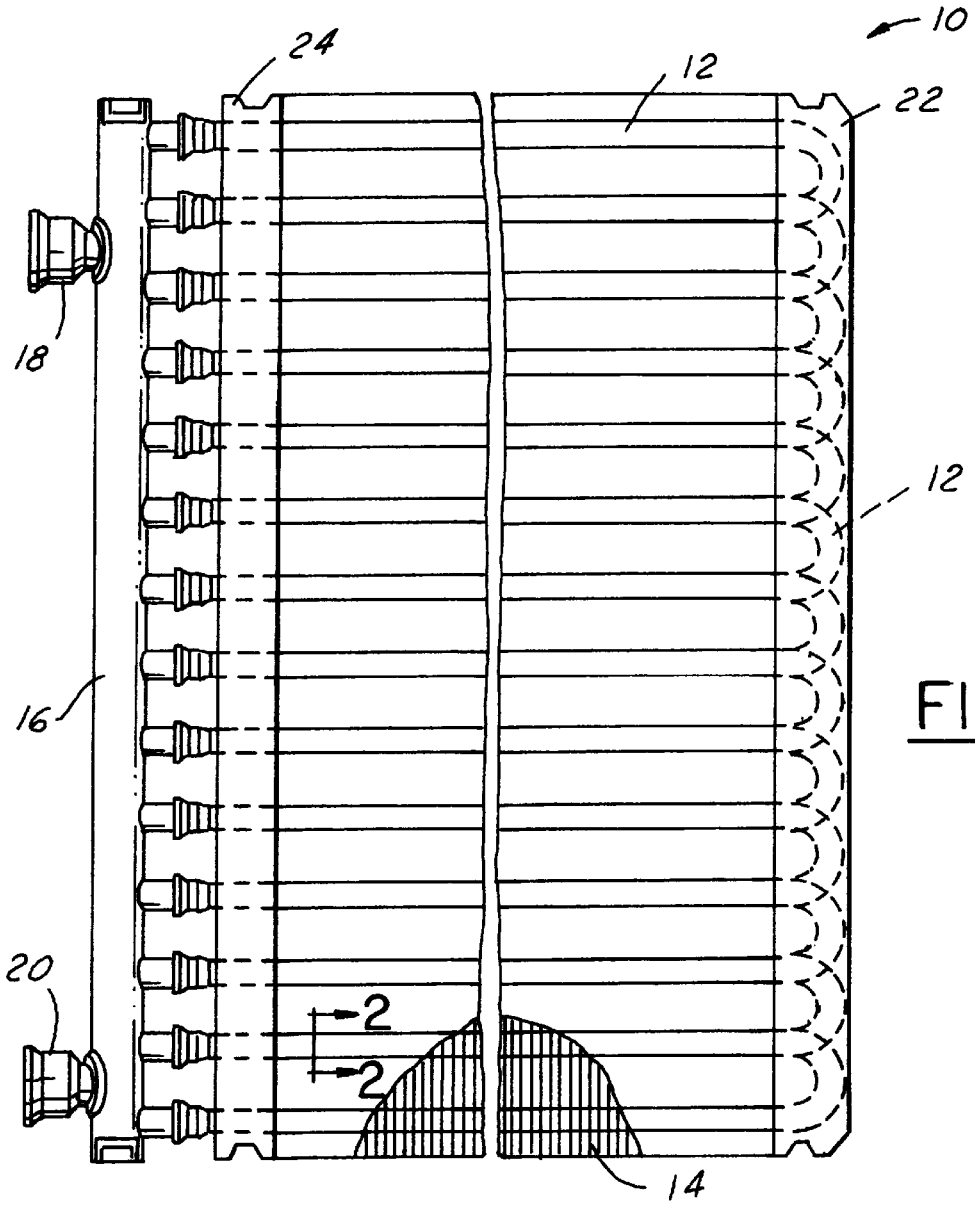
FIG. 1 is a perspective view of a tube and fin heat exchanger including a plurality of tubes structured in accord with the principles of the present invention.

Referring now to the drawings, FIG. 1 shows a tube and fin heat exchanger, such as a condenser 10 including a plurality of hairpin-shaped tubes 12 with heat dissipative fins 14 interposed between each of the tubes. The free ends of the hairpin tubes 12 engage a manifold 16 disposed at one end of the heat exchanger 10. The manifold 16 can be any of a number of known configurations of manifolds, such as that disclosed in U.S. Pat. No. 5,190,101, assigned to the assignee of the present invention. As shown in the '101 patent, the manifold is a double-chamber manifold having a first and second fluid conduit, including an inlet port 18 for receiving fluid therein and an outlet port 20 for discharge of fluid therefrom. As further explained in the '101 patent, the manifold includes a plurality of baffles for directing the fluid through the heat exchanger according to a predefined pathway. In accordance with principles well known in the heat exchanger art, fluid to be cooled (or heated) enters the manifold through the inlet port 18 and is directed through the plurality of hairpin-shaped tubes 12 wherein the fluid is cooled by the secondary fluid, such as air passing over the fins 14. The baffles in the manifold direct the fluid through the hairpin tubes wherein the fluid eventually discharges from the outlet port 20. It should be apparent to those skilled in the art that the heat exchanger in FIG. 1 can utilize a manifold having a single fluid conduit or a multiple fluid conduit.

The present invention will be described herein with reference to the condenser 10 of FIG. 1. However, it will become apparent to those skilled in the art that the present invention can be utilized with other tube and fin heat exchangers, such as oil coolers, radiators and the like which use straight, not hairpin-shaped tubes, and fluid conduit assemblies, such as tanks in place of manifolds.

The condenser 10 further includes a pair of tube support members, such as endsheets 24, 22. One endsheet 24 is disposed adjacent the manifold while the second endsheet 22 is disposed at an opposite end of the condenser from the manifold 16. Each of the endsheets supports the tubes 12 and can further be utilized as attachment means for attaching the condensers to the vehicle. The endsheets 24, 22, are generally U-shaped members, having a planar base portion and a pair of flanges extending perpendicularly therefrom. The endsheets include a plurality of tube-receiving apertures therein.

Figure 2:
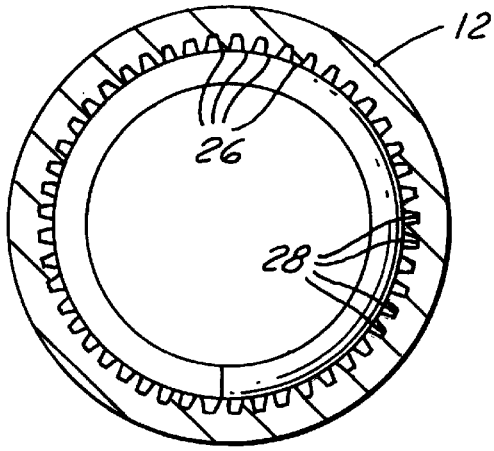
FIG. 2 is a cross-sectional view of a heat exchanger tube in FIG. 1 taken along line 2—2.

As shown in more detail in FIG. 2, each of the tubes 12 of the present invention includes a corrugated cross-section comprising a plurality of alternating projections 26 and recesses 28. The projections 26 are integrally formed with the tubing during an extrusion process and are typically formed of an aluminum alloy. The projections and recesses are disposed longitudinally along the longitudinal axis of the tubes.

As should be well known to those in the art, this tube configuration is merely an example and not meant to be a limitation upon the present invention since these values can change depending upon the heat capacity requirements of the heat exchanger.

Referring now to FIGS. 3A–3C, 4A–4C, and 5A–5C, three embodiments of a turbulator 30 of the present invention are shown. The turbulator 30 is an elongated length of a coil spring 32 having a non-uniform diameter along its length. The length of the turbulator 30 is approximately equal to the length of the tube into which it is inserted. Each turbulator 30 includes a plurality of coil sections 34 having a predetermined number of coils 36. The coils 36 in each section 34 have equal diameter, Dc, and this diameter is slightly greater than or equal to the inner diameter of the tube 12 into which the turbulator is inserted. This insures that the turbulator 30 will contact the interior surface of the tube wall to increase the heat transfer efficiency of the tube 12.

Each of the turbulators 30 also includes a predetermined number, usually one to three, of transitional coil members 38. The transitional coil members 38 are spaced between coil sections 34. Typically, the transitional coil members 38 have diameters, Dt, smaller than the diameters of the coils in the coil sections 34. The height of the transitional coil members, Ht, can be equal to the height of the coil section coils, Hc, or smaller as will be described.

Figure 3C:
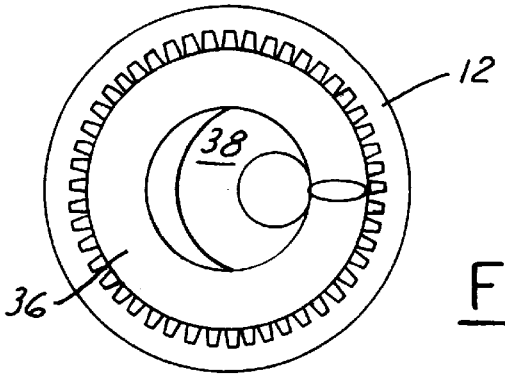
FIGS. 3A–C are different views of one embodiment of a turbulator of the present invention.
Figure 3B:
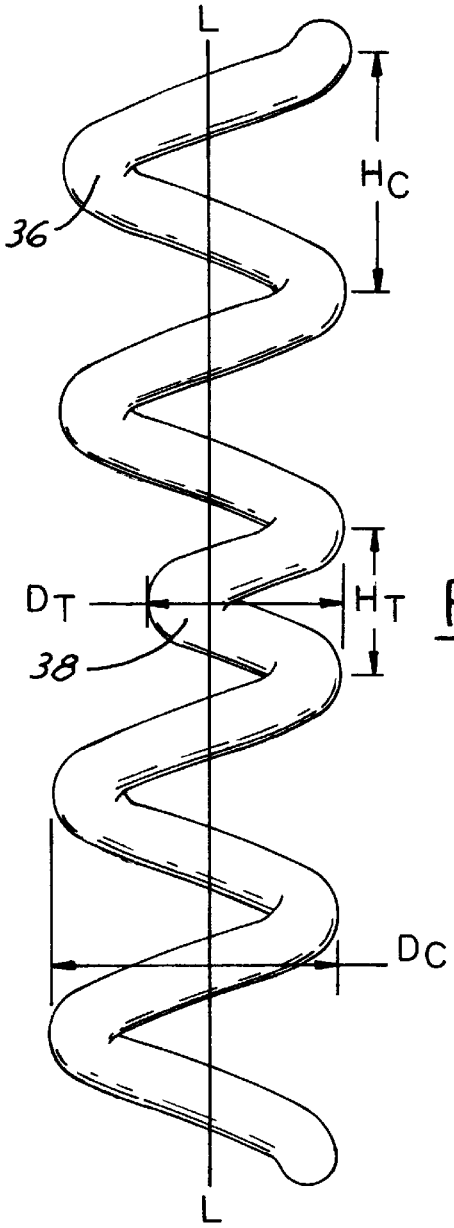
Figure 3A:
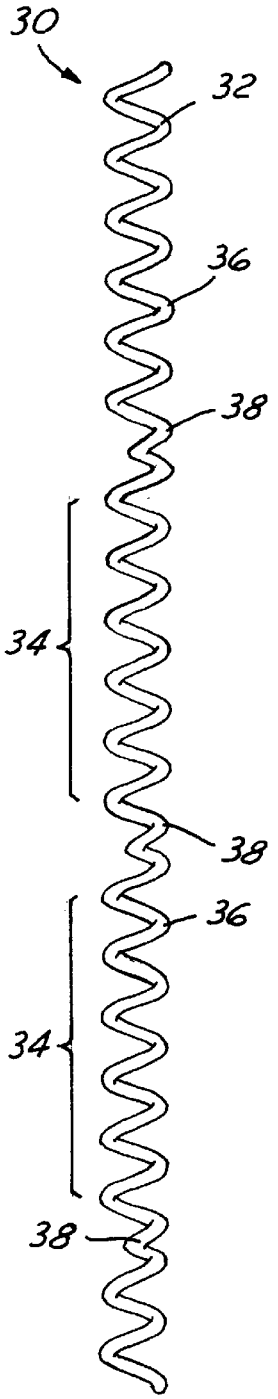

FIGS. 3A–3C illustrate the geometry of one embodiment of a turbulator 30 used with the present invention. There are three full coil sections shown in FIG. 3A with three sets of transitional coil members 38 placed between the sections 34. As shown in more detail in FIG. 3B, the transitional coil member 38 has a height, Ht, which is significantly less than the height, Hc of one coil member in the coil section 34. Similarly, the diameter of the transitional coil member is smaller as well. In the FIG. 3 embodiment, the transitional coil member 40 is offset from the longitudinal axis of the turbulator as designated by line L—L. This provides the advantage as shown in FIG. 3C wherein the offset transitional coil member interrupts the flow of fluid directly down the center of the tube. By interrupting flow down the center of the tube, the fluid is forced to the walls of the tube to provide more surface area for heat transfer.

Figure 4C:
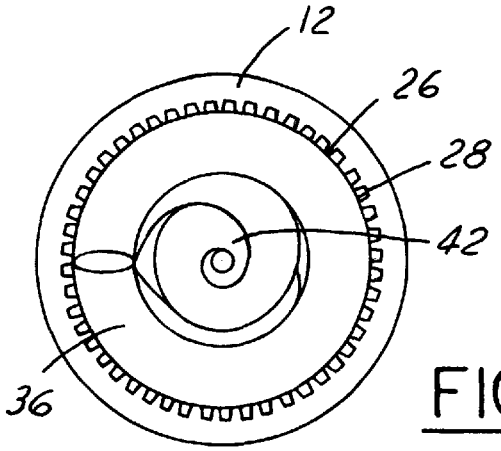
FIGS. 4A–C are different views of another embodiment of a turbulator of the present invention.
Figure 4B:
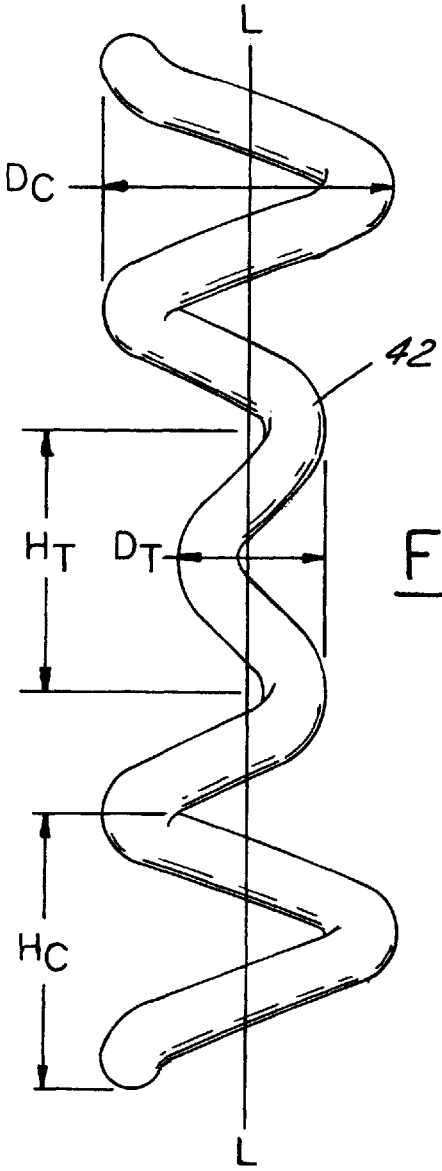
Figure 4A:
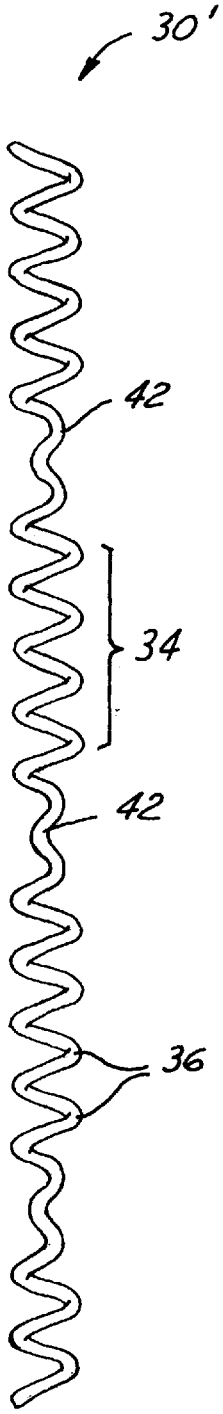

FIGS. 4A–4C illustrate a second embodiment of a turbulator 30'. The difference between the turbulator of FIG. 3 and that of FIG. 4 primarily is the transitional coil members 42. In FIGS. 4A–C, the transitional coil members 42 have a height, Ht which is equal to the height of the coil section coils. During operation, as a fluid flows longitudinally through the tubes, passing over the coil members 34, 42, the abrupt fluctuation in diameter of the coil members forces a portion of the flow to be directed toward the alternating projections 26 and recesses 28 formed on the inside wall of the tubes 12 and then returns this flow toward the center of the coil. In doing so, turbulence is induced, and thus the heat exchange is made greater. In a preferred embodiment of the present invention, the common helical diameter of the coil is 5.0 mm, whereas the helical diameter of the transitional coil members 42 is at least half this, 2.5 mm. The height of the coils is about 4.25 mm. Each change in the coil member diameter is evenly spaced by four helical turns and is symmetrical about axis L—L. As should be well known to those in the art, these the present invention since these values can change depending upon the heat capacity requirements of the heat exchanger.

Figure 5C:
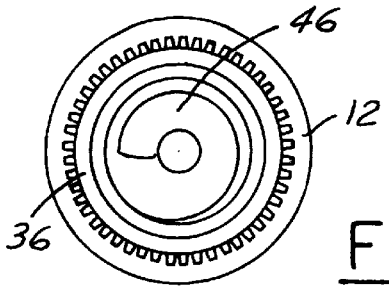
FIGS. 5A–C are different views of yet another embodiment of a turbulator of the present invention.
Figure 5B:
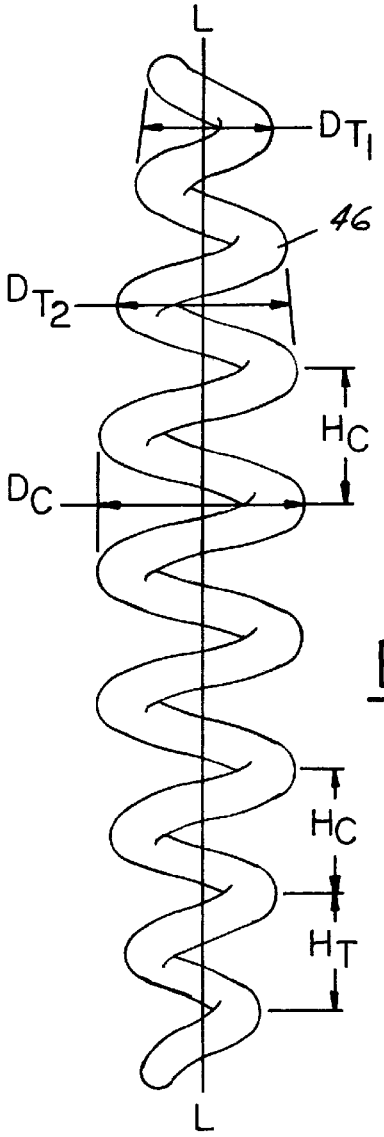
Figure 5A:
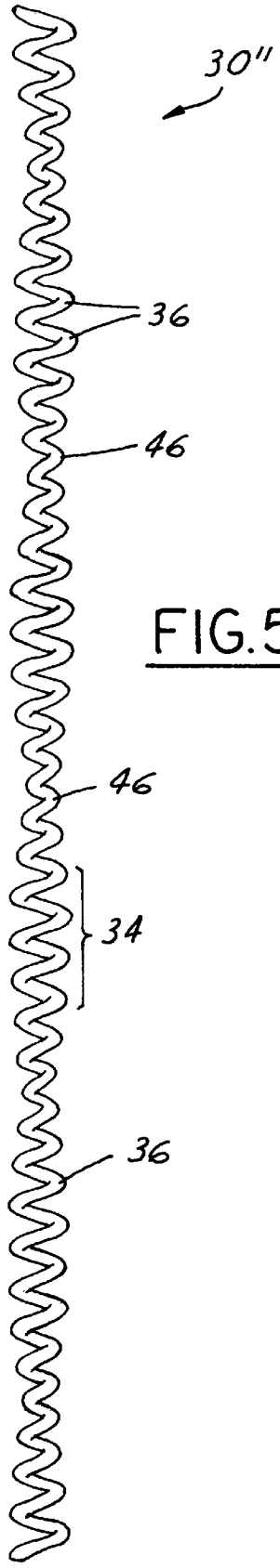

Turning now to FIGS. 5A–5C, which depict an alternative embodiment of the present invention, the turbulator 30" functions similarly to those of the alternative embodiments described above. The turbulator 30" also causes turbulence in the flow of the heat conducting medium. The turbulator 30" includes coil sections 34, each having only two or three coil members per section, while the transitional coil members 46 having gradually increasing diameters such that Dt1 is less than Dt2. The coil members are symmetrical about the longitudinal axis of the turbulator.

Variations and modifications to the present invention will, no doubt, occur to those skilled in the art. For example, the coil sections can be broken into separate segments instead of being a one piece unit. Also, the present invention has been described with reference to a condenser having hairpin shaped tubes. However, the same principles can be applied to other heat exchangers having parallel tubes or the like. It is the following claims, including all equivalents, which define the scope of my invention.

What is claimed is:

1. A heat transfer device comprising:

a thermally conductive tube having an interior surface of a predetermined interior diameter extending between opposite ends and adapted for receiving a flow of fluid therethrough; and a fluid flow turbulator disposed in said tube and approximately equal in length to said tube, said turbulator having a longitudinal axis parallel to a longitudinal axis of said tube, at least a portion of said turbulator being in contact with said interior surface of said tube, said turbulator including an elongated length of a helical coil spring having a non-uniform diameter along its length, said spring having a first plurality of separate coil sections each with a plurality of coils of uniform height and uniform diameter approximately equal to said interior diameter of said tube and being in contact with said interior surface of said tube, said spring having a second plurality of transitional coil members each being connected between adjacent ends of a pair of said coil sections, each of said transitional coil members having a diameter smaller than said interior diameter of said tube and being offset from said longitudinal axis of said turbulator so as to form an obstructed fluid flow path through said tube and direct fluid flowing through said tube to said interior surface of said tube.

2. The heat transfer device according to claim 1 including a plurality of alternating longitudinally extending projections and recesses forming said interior surface of said tube.

3. The heat transfer device according to claim 1 wherein said transitional coil members have a coil height no greater than a coil height of said coil sections.

4. The heat transfer device according to claim 1 wherein said coil members have a single coil and said coil sections have at least two coils.

5. The heat transfer device according to claim 1 wherein said tube has a hairpin shape.

6. A heat exchanging device comprising:

a thermally conductive tube having an interior surface formed of a plurality of alternating longitudinally extending projections and recesses and being a predetermined interior diameter and adapted for receiving a flow of fluid therethrough; and a fluid flow turbulator disposed in said tube and having a length approximately equal to a length of said tube, said turbulator having a longitudinal axis parallel to a longitudinal axis of said tube, at least a portion of said turbulator being in contact with said projections of said interior surface of said tube, said turbulator including an elongated length of a helical coil spring having a non-uniform diameter along its length, said spring having a first plurality of separate coil sections each with a plurality of coils of uniform height and uniform diameter approximately equal to said interior diameter of said tube and being in contact with said projections, said spring having a second plurality of transitional coil members each being connected between adjacent ends of a pair of said coil sections, each of said transitional coil members being smaller in diameter than said interior diameter of said tube interrupt the flow of fluid through a longitudinal center of said tube interior.

7. The heat transfer device according to claim 6 wherein said coil members have coils of different diameters.

* * * * *